US008266863B2

(12) United States Patent
Knauseder

(10) Patent No.: US 8,266,863 B2
(45) Date of Patent: Sep. 18, 2012

(54) KIT FOR JOINING FLAT, RELATIVELY THIN MEMBERS THAT ADJOIN EACH OTHER ALONG THEIR NARROW FACE

(75) Inventor: Franz Knauseder, Österreich (AT)

(73) Assignee: M. Kaindl, Salzburg (AT)

( * ) Notice: Subject to any disclaimer, the term of this patent is extended or adjusted under 35 U.S.C. 154(b) by 2701 days.

(21) Appl. No.: 10/473,909

(22) PCT Filed: Apr. 4, 2002

(86) PCT No.: PCT/AT02/00102

§ 371 (c)(1),
(2), (4) Date: Oct. 3, 2003

(87) PCT Pub. No.: WO02/081843

PCT Pub. Date: Oct. 17, 2002

(65) Prior Publication Data

US 2004/0139676 A1 Jul. 22, 2004

(30) Foreign Application Priority Data

Apr. 5, 2001 (AT) ..... A 555/2001

(51) Int. Cl.
*E04B 2/00* (2006.01)

(52) U.S. Cl. ..... 52/586.2; 52/582.1; 403/293

(58) Field of Classification Search ..... 52/586.1, 52/586.2, 582.1; 403/293
See application file for complete search history.

(56) References Cited

U.S. PATENT DOCUMENTS 1,889,138 A * 11/1932 Wolfson ..... 52/512
2,049,371 A * 7/1936 Haley ..... 52/376
2,286,019 A * 6/1942 Smith ..... 404/47
5,058,333 A * 10/1991 Schwartz ..... 52/73
5,062,250 A * 11/1991 Buzzella ..... 52/586.2
5,182,891 A * 2/1993 Slocum ..... 52/480
6,460,306 B1 * 10/2002 Nelson ..... 52/582.1

(Continued)

FOREIGN PATENT DOCUMENTS

AT A 555/2001 4/2002

(Continued)

*Primary Examiner* — Brian Glessner
*Assistant Examiner* — Adriana Figueroa
(74) *Attorney, Agent, or Firm* — Andrew M. Calderon; Roberts Mlotkowski Safran & Cole, P.C.

(57) ABSTRACT

The system relates to a system for joining flat, relatively thin members that adjoin one another along their narrow face, the members having grooves incorporated into the narrow faces that are parallel to the surface and have groove walls that are parallel to each other, and the joining element being inserted into the grooves of two adjacent members and bridging the partition gap between the members in the manner of an external tongue. In this context the joining element (11) has, on its part (12) that can be inserted in the manner of an external tongue in the longitudinal center on its side that faces away from the visible surface of the members, one continuous web or a plurality of aligned webs (13) that preferably protrude at a right angle, from which detent webs (14, 15) protrude on both sides, each of which has a detent projection (16, 17) that projects toward the external-tongue-like part (12), and on the bottom of the member (1, 2), which faces away from its visible surface, detent grooves (7, 8) being provided that run parallel to the adjacent edge at a distance corresponding to the width of the detent webs (14, 15).

25 Claims, 2 Drawing Sheets

U.S. PATENT DOCUMENTS

| | | | | |
|---|---|---|---|---|
| 6,729,091 | B1 * | 5/2004 | Martensson | 52/391 |
| 6,763,643 | B1 * | 7/2004 | Mårtensson | 52/586.1 |
| 6,769,217 | B2 * | 8/2004 | Nelson | 52/582.1 |

FOREIGN PATENT DOCUMENTS

| | | | |
|---|---|---|---|
| DE | 8604004 | | 4/1986 |
| DE | G 86 04 004 9 | | 6/1986 |
| EP | 0813641 | | 7/2001 |
| GB | 2 124 672 | A | 2/1984 |
| SE | 8202375-5 | | 4/1982 |
| SE | 8 202 375 | A * | 10/1983 |
| WO | 94/01628 | | 1/1994 |
| WO | 94/26999 | | 11/1994 |
| WO | WO 00/20706 | | 4/2000 |

* cited by examiner

KIT FOR JOINING FLAT, RELATIVELY THIN MEMBERS THAT ADJOIN EACH OTHER ALONG THEIR NARROW FACE

BACKGROUND OF THE INVENTION

1. Field of the Invention

The invention relates to a system for joining flat, relatively thin members that adjoin one another along their narrow face, the members having grooves incorporated into the narrow faces that are parallel to the surface and have groove walls that are parallel to each other, and the joining element being inserted into the grooves of two adjacent members and bridging the partition gap between the members in the manner of an external tongue.

2. Background Description

Configurations of this kind have the advantage that all members are formed completely the same; that is, it is not necessary to ensure that a side with a groove always faces a side with a tongue, such members also being substantially easier to manufacture. In the installation of this known configuration, external tongues are used, whereby the flat member to be attached may be attached without regard to its edge configuration. These known configurations have the disadvantage that, when installing them, there must be two gluing operations at each plate abutment because the external tongue has to be anchored with both longitudinal edges, namely once on a plate-like member and with the other longitudinal edge in the other member.

In order to generally avoid gluing at the installation site, disposing detent elements in the area of the tongue-and-groove joint in such a manner that projections provided on the tongue snap into corresponding recesses of the groove walls when the flat members that are to be arranged next to each other are joined is already known. However, in these known designs, especially in those in which the flat joining elements are formed from the same material as the plates themselves, one must ensure that the groove walls are elastic enough that the front edges of the groove walls in the direction of insertion can be moved far enough away from each other that the projections provided on the tongue can be moved in between the front edges of the groove walls without causing damage. In members formed from fiber plates, deficient quality in the fiber plates can in fact cause the groove walls to break through or break away, causing this member to then be unusable. This is especially true if substantial forces are exerted on the groove walls because of a steep inclination of the projections when joining the narrow faces of the members, as is the case, for example, in European Patent Application Publication no. 813 641.

Furthermore, providing snap-fit elements made of synthetic material on the back side of the panels whereby the narrow faces of the members are provided with gradations that engage within each other when the plates are fit together was already known. That plate on which the elastic snap-fit element is mounted forms a "groove" together with the stepped wall in which the projection of the step of the adjacent plate is insertable in the manner of a "tongue". That plate on which the step to be inserted as a "tongue" is provided has a recess on the back side in which the snap-fit element of the additional snap-fit organ that is to be fastened to the other plate engages. A design of this type has the disadvantage, especially with thin plates, that only a little material is available for clamping the additional snap-fit organ, whereby the step flanks must absorb the forces that are required to move away the snap-fit element when joining together the plates. Although it is described within the context of this design that the member to be joined is swung "tongue-first" into the "groove" on the other member, this requires an appropriate amount of play between the step walls that run roughly parallel to the top surface, because otherwise the swinging in is not possible or is possible only when swinging away the snap-fit organ, which again exerts substantial forces on the steps. A design of this type emerges from WIPO patent 94/26999. However, such play permits limited movement on both sides, which is especially disadvantageous for floors.

Furthermore, incorporating tongue-and-groove joints made of synthetic material in the edges of the members, for example, by pouring them in during injection molding or otherwise incorporating them into the material in order to be able to absorb the spreading forces of the groove when joining the members, using not a wood-based material, but an elastic material. Such a design emerges from WIPO patent 94/01628, in which design the tongue is also slit along its longitudinal center plane, thereby enabling it to be slightly compressed. Designs of this type are not usable in terms of manufacturing technology with members that are based on wood materials, because in the process wall thicknesses that are too thin may result, which may easily lead to a danger of breakage when joining and also when shipment is not entirely proper.

SUMMARY OF THE INVENTION

The object of the present invention is to provide a system of the type mentioned at the outset with which, on the one hand, a secure joint between the two adjacent members is achievable, but the danger of breakage and the danger of the members coming apart from each other with use is prevented.

According to the invention, this objective is achieved by virtue of the joining element having, on its part that can be inserted in the manner of an external tongue in the longitudinal center on its side that faces away from the visible surface of the members, one continuous web or a plurality of aligned webs that preferably protrude at a right angle, from which detent webs protrude on both sides, each of which has a detent projection that projects toward the external-tongue-like part, and on the underside of the member, which faces away from its visible surface, detent grooves being provided that run parallel to the adjacent edge at a distance corresponding to the width of the detent webs. In this way the joining elements that are integrally molded with the members, or molded in them, are not subjected to bending stress, but only to compression, because bending only occurs on the joining element, and specifically between the part that can be inserted in the manner of an external tongue and the associated detent webs, whereas the projecting area of the member that is to be inserted between these two parts of the joining element is subject to no bending forces whatsoever, because the groove walls, which have the part that can be inserted in the manner of an external tongue, run parallel to each other, and bending of the groove cheeks of the members is thus avoided.

In order to achieve a secure hold between joining element and the associated members, the delimiting surface of the detent projection that extends from the detent web may be inclined at an angle equal to or greater than 85°, preferably 90°-100°, the opposite surface of the detent groove having the same inclination. With angles greater than 90° there is also a drawing of the area of the member that engages between the external-tongue-like part of the joining element and the detent web into the joining element when the detent projection(s) is(are) moved into the detent groove(s). As a result, the groove cheek that faces away from the visible surface can be shorter than the groove cheek that is adjacent to the visible surface by at least about half the thickness of the web, thereby achieving, when used in floors for example, a secure adjoining of the areas of the narrow faces that meet at the surface, and thus a tighter surface connection. In order achieve a gentle sliding of the detent projections onto the associated part of the member, the inclination of the run-in surface of the detent projections and of the outer edge of the associated groove cheek can be roughly equal. To produce a flat foundation, the detent profile that is molded in on the bottom side of the member can be sunken into the bottom by roughly at least the thickness of the detent webs, thereby causing the member to lie flat against the associated foundation.

BRIEF DESCRIPTION OF THE DRAWINGS

In the drawing, two exemplary embodiments of the subject matter of the invention are shown.

DETAILED DESCRIPTION OF INVENTION

Figure 1:
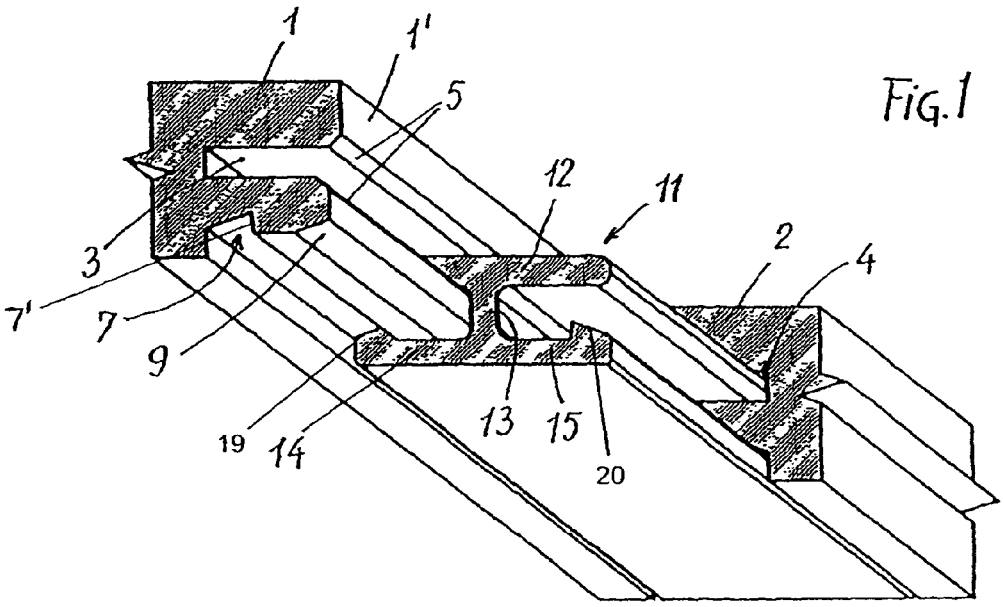
FIG. 1 diagrammatically shows two members that are joined by means of the system of the present invention.

The two members are labeled 1 and 2 that are to be joined side-by-side along their narrow faces 1', 2'. Members 1, 2 on their narrow faces 1', 2' have grooves 3, 4 whose lateral flanks run parallel to each other. In the given exemplary embodiment, the lateral surfaces of grooves 3, 4 also run parallel to the top of members 1, 2. The lateral walls of grooves 3, 4 transition into narrow faces 1', 2' via bevels 5 or 6. On the bottom, members 1, 2 have detent grooves 7, 8 that are provided with run-in surfaces 9, 10, which are disposed running outward from narrow faces 1', 2' at an angle to the bottom of members 1, 2 and transition into detent grooves 7, 8.

Figure 2:
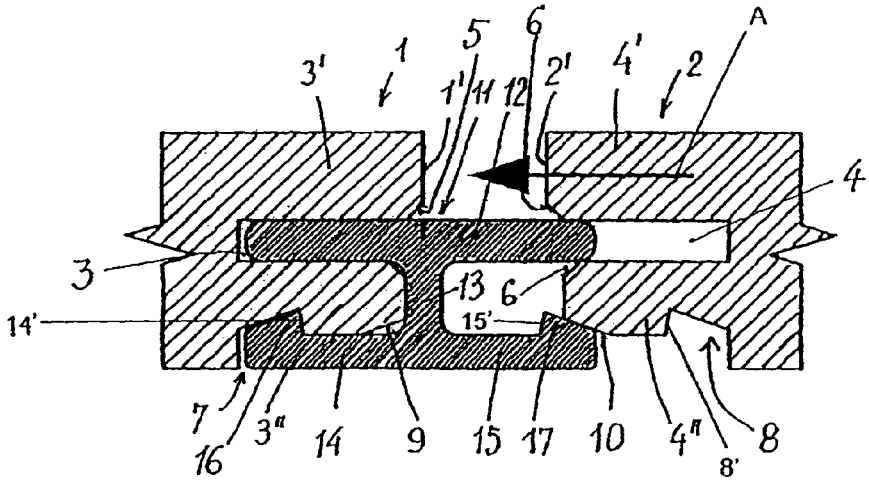
FIG. 2 is a section through two plates in the junction area during the attachment of the second plate.
Figure 3:
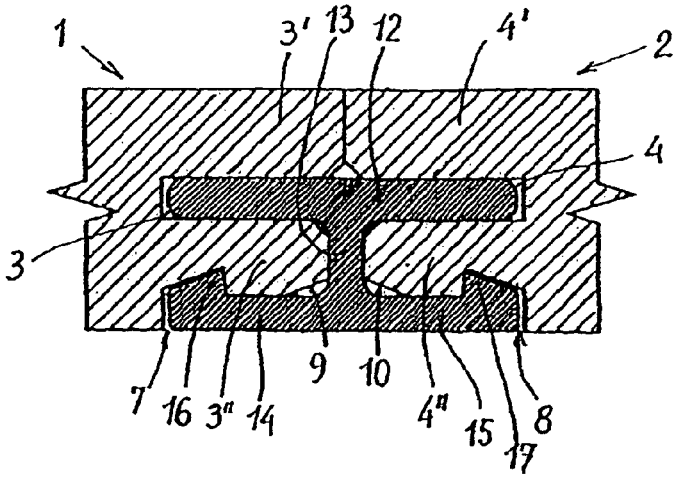
FIG. 3 depicts the junction area of two plates when the plates are in a joined state.

A joining element 11, which has an external-tongue-like part 12 that can be inserted into grooves 3, 4 (e.g., as depicted in FIG. 2, where arrow "A" shows attachment of the member 2) in such a manner as to bridge the inner gap, is provided for joining members 1, 2. The open longitudinal edges of tongue-like part 12 are, as can be seen in the figures, rounded or beveled in order to more easily be introduced along bevels 5, 6 into grooves 3, 4. The thickness of the external-tongue-like part 12 corresponds roughly to the distance of the lateral walls of grooves 3, 4 from each other. A junction web 13, at whose bottom end detent webs 14, 15 protrude in the front roughly parallel to tongue-like part 12, goes out from external-tongue-like part 12 at a right angle. Detent projections 16, 17 that project toward tongue-like part 12 are provided on these detent webs and are configured to snap into detent grooves 7, 8. The detent projections have wedge surfaces 19, 20 that are inclined in a manner corresponding to the inclination of run-in surfaces 9, 10 and transition on their back sides into fitting surfaces 14', 15', fitting surfaces 7', 8' being provided in the detent grooves against which fitting surfaces 14', 15' of the detent projections come to rest. Due to the reciprocal support of the fitting surfaces, a latching of the joining element to adjacent members 1 and 2 is achieved. Because of the inclination of fitting surfaces 7', 8' or 14', 15', the joining element 11 is drawn into the corresponding member when detent projections 14, 15 are moved into detent groove 7, 8, which as a further consequence means that the members are pulled against each other and narrow faces 1', 2' are pressed against each other.

Figure 4:
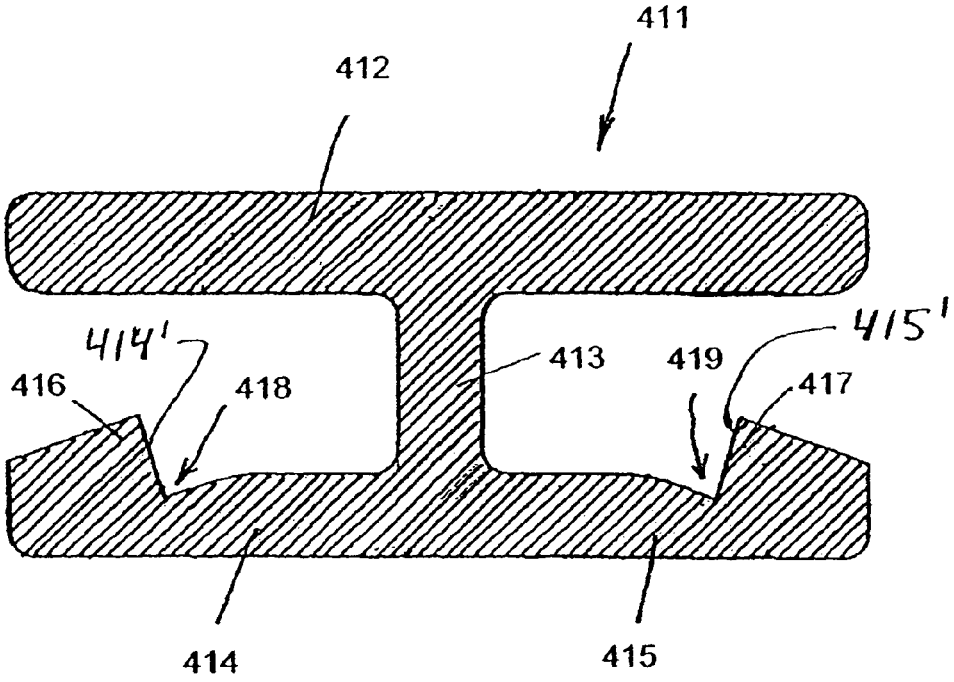
FIG. 4 shows a cross-section through a second design variant of the joining element.

In the design variant according to FIG. 4, a joining element 411 includes tongue like part 412 and junction web 413. Moreover, undercuts 418, 419, which produce a slight bending resistance of the detent webs when they are pushed in because of the reduction of the wall thicknesses of the detent webs, are provided behind fitting surfaces 414', 415' in addition to the details on detent webs 414, 415 that have already been described. Also, it is slightly more possible in this way to have a loosening of the parts, because, when members 1 and 2 are pulled out from each other, the detent projections around the area of the undercut of the detent webs can be pivoted, thereby enabling detent projections 416, 417 to be moved out from detent grooves 7, 8.

What is essential in the present design is that groove flanks 3', 3" or 4', 4", which are formed by grooves 3, 4, are not subjected to bending stress when external-tongue-like part 12 is pushed in, but instead the entire bending force or excursion movement of the detent projections is exerted out on joining element 11, and in particular by the run-in surface of detent projections 16, 17 running in against corresponding run-in surfaces 9, 10 of groove flanks 3', 4' and by facilitating the excursion of the detent webs without an abrupt increase in force during the insertion.

Depending on the material selected for joining element 11, the holding force can be controlled, specifically, on the one hand, in that the individual parts firmly snap together and securely drawing into each other, whereby a loosening of the parts from each other again can also be facilitated. Such a loosening can be achieved or prevented, on the one hand, by the selection of the inclination of fitting surfaces 7', 8' or 14' 15', if the angles are less than 90°. Then this results in a latching of the two parts to each other, whereby, when forces act in the direction of pulling the parts apart, there is a drawing into the associated detent groove because of reciprocal inclination of the detent projection.

The joining element could be formed, in a manner not shown here, in two or more parts, specifically in such a manner that the detent webs are fitted on external-tongue-like part 12 or on web 13 as a separate element, which would have the advantage that, because of the selection of different materials on the one hand, a rigid external-tongue-like guide is obtained in the area of external-tongue-like part 12 and grooves 3, 4, and, on the other hand, a material of high elasticity and stability of shape that poses very little resistance to the joining together of the parts, for example a spring steel or the like, can be used in the area of the detent webs. The wall thickness of the spring steel may also be less than the wall thickness of, for example, external-tongue-like junction web 12.

As is evident from the present drawing, bottom groove flank 3" or 4" is slightly shorter than top flank 3', 4', which is necessitated by the fact that face surfaces 1', 2' must rest against each other tightly in order to achieve a tight adjacent placement of the members. However, web 13 is provided in the area of the lower groove flanks 3", 4", so that these groove flanks may be configured to be shorter by half the thickness of web 13. In this way an abutment of the faces of groove flanks 3", 4" against the lateral surfaces of web 13, 14 is ensured, which produces an exceptionally stable joint.

Furthermore, a formation sunk into the back side of members 1, 2 is shown in the drawing, but the hollowed area can be omitted when an underlayment plate that is bent back appropriately is used, whereupon there is less of a weakening of bottom groove flank 3", 4".

The features and advantages of the subject matter of the invention are presented again in summarized form below:

a) All existing production cylinders may be preserved, because absolutely no geometric alterations to the surface of the member are called for, b) A simple double profile, which may be made out of PVC, aluminum or similar materials, is used as a joining element and may be produced in a simple manner by extrusion.

c) The snapping operation is accomplished using only the return force of the joining profile and does not depend on the lateral tensile strength of the carrier plate.

d) The strength of the joint may be affected by the height of the detent projection, the wall thickness of the detent web and by the material selected.

e) The automatic closure of the partition gap between the two members and also the strength of the joint can be controlled by the inclination of the fitting surfaces on the detent projection and also on the detent groove.

f) The joining element can be pre-mounted on a longitudinal and a lateral side during production, specifically by pressing it in using an appropriate device, which makes installation easier.

g) The members have the same profile on all four sides, thereby achieving a simple manufacture of the members without milling cutters that are formed in a complicated manner having to be used.

h) The flush alignment of the members is produced by the external-tongue-like part of the joining element.

i) The grooves for acceptance of the external-tongue-like part extend at a right angle from the narrow face surfaces and thus parallel to the surfaces of members 1, 2, thereby achieving a precise joining of the members.

j) The detent grooves for the detent projections are placed in the bottom side of the members and are therefore relatively easy to mill and also easy to check.

k) The joining elements can be milled on four spindles.

l) Because no tongues are milled on the members, milling cutters that correspond in width to the formatting can be used and often can be adjusted in height accordingly.

The thickness of the members may be varied in accordance with the particular circumstances or the type of the two members, whereby MDF plates, that is medium thickness fiber plates, may be used in laminate floors because of the lower stress. With plates of this type, it is nevertheless beneficial to provide at least a thickness of 2.4 mm as a lower groove flank, which may be achieved either by increasing the overall thickness of the member or laminate flooring plate to, for example, 8 mm or, as already indicated, by selecting the configuration of the detent groove such that the detent webs are not sunken into the plate level.

While the invention has been described in terms of preferred embodiments, those skilled in the art will recognize that the invention can be practiced with modification within the spirit and scope of the appended claims.

What is claimed is:

1. A kit comprising plate members and a joining element for joining the members that are adjacent along their narrow faces, the members having grooves incorporated into the narrow faces, the grooves being parallel to a visible surface and having groove walls that are parallel to each other, and the joining element that is associated with the adjacent members being insertable into the grooves of the members and bridging a gap between the members in a manner of an external tongue, the joining element including the external tongue and a web that protrudes at a right angle at a longitudinal center of the external tongue on its side that faces away from the visible surface of the members, from which detent webs protrude on both sides, each of which detent web has a detent projection that projects toward the external-tongue, and on an underside of each member, detent grooves being are provided that run parallel to the narrow faces and which align with said detent projections on the detent webs, wherein a lateral extension of the external-tongue and the detent webs are approximately equal and wherein the underside faces away from the visible surface.

2. The kit as described in claim 1, wherein a fitting surface of the detent projection that goes out from the detent web is inclined at an angle that is equal to or greater than 85°, an opposite surface of the detent groove having a same inclination.

3. The kit as described in claim 1, wherein a groove flank that is below the groove is shorter than a groove flank that is adjacent to the visible surface by approximately at least half a thickness of the web.

4. The kit as described in claim 1, wherein an inclination of wedge surfaces of the detent projections and an inclination of run-in surfaces of an outside edge of an associated groove flank are approximately equal.

5. The kit as described in claim 1, wherein the detent groove that is integrally formed on the underside of the member is sunken into the underside by approximately at least the thickness of the detent webs.

6. The kit as described in claim 2, wherein a groove flank that is below the groove is shorter than a groove flank that is adjacent to the visible surface by approximately at least half the thickness of the web.

7. The kit as described in one of claim 2, wherein an inclination of wedge surfaces of the detent projections and an inclination of run-in surfaces of an outside edge of an associated groove flank are approximately equal.

8. The kit as described in one of claim 3, wherein an inclination of wedge surfaces of the detent projections and an inclination of run-in surfaces of an outside edge of the associated groove flank are approximately equal.

9. The kit as described in one of claim 2, wherein the detent groove that is integrally formed on the underside of the member is sunken into the underside by approximately at least the thickness of the detent webs.

10. The kit as described in one of claim 3, wherein the detent groove that is integrally formed on the underside of the member is sunken into the underside by approximately at least the thickness of the detent webs.

11. The kit as described in one of claim 4, wherein the detent groove that is integrally formed on the underside of the member is sunken into the underside by approximately at least the thickness of the detent webs.

12. The kit as described in claim 1, wherein upper groove walls of the groove walls include bevels extending into the grooves.

13. The kit as described in claim 1, further comprising a run-in surface on a lower groove flank of each member.

14. The kit as described in claim 13, further comprising a lower bevel on the lower groove flank and an upper bevel on an upper groove flank of each member.

15. The kit as described in claim 14, wherein the run-in surfaces transition into the detent grooves.

16. The kit as described in claim 1, wherein the external tongue is rounded or beveled.

17. The kit as described in claim 1, wherein the detent webs include undercuts which produce a slight bending resistance of the detent webs.

18. The kit as described in claim 1, wherein the detent webs have a reduction of wall thicknesses behind fitting surfaces of the detent projections.

19. A kit comprising a joining element comprising a central web member, tongues protruding from both sides of the web member at a first end and detent webs protruding on both sides of the web member at a second end, the tongues having rounded or beveled edges, the tongues and the detent webs being of substantially a same length, the detent webs including detent projections configured to extend within detent grooves of plate members, the detent webs each having an angled wedge surface, and further comprising at least two plate members each having grooves on a narrow facing side, the grooves being formed by upper and lower groove walls, the lower groove walls including angled run-in surfaces on an underside extending from the narrow facing side to detent grooves, the run-in surfaces configured to contact with the wedge surfaces.

20. The kit as described in claim 2, wherein the angle is in a range of 90° to 110°.

21. A kit, comprising:

a joining element; and at least two flooring plate members;

the joining element is structured and arranged to connect the at least two flooring plate members and comprises:

a central web member;

tongues protruding from both sides of the web member at an upper end and detent webs protruding on both sides of the web member at a lower end, wherein the tongues and the detent webs have substantially a same length; and a fitting surface and an upward facing angled wedge surface arranged on each detent web; and each of the at least two flooring plate members comprises:

a top side;

a groove parallel to the top side and arranged to accommodate one of the tongues of the joining element, wherein the groove is defined by an upper groove flank and a lower groove flank;

a run-in surface on the lower groove flank having an inclination corresponding to an inclination of the wedge surface of one of the detent webs; and another fitting surface on the lower groove flank arranged to abut against the fitting surface of one of the detent webs in an assembled state of the joining element and the at least two flooring plate members, wherein, in the assembled state, a gap exists between an outermost surface of each detent web and a corresponding surface of each flooring plate member.

22. The kit as described in claim 19, wherein the detent projections are configured to press the plate members together.

23. The kit as described in claim 19, wherein the angled wedge surface is a run in surface that faces away from the web member.

24. The kit as described in claim 19, wherein the rounded or beveled edges of the tongue extend to an upper and lower surface of the tongue.

25. The kit as described in claim 19, wherein the detent webs include undercuts which produce a slight bending resistance of the detent webs.

* * * * *